US008240004B2

(12) United States Patent
Carpinella et al.

(10) Patent No.: US 8,240,004 B2
(45) Date of Patent: Aug. 14, 2012

(54) REPLACEMENT FURNITURE GLIDE

(75) Inventors: Ralph Carpinella, Woodbury, CT (US); Robert Dombroski, Waterbury, CT (US); David Ferraro, Cheshire, CT (US)

(73) Assignee: Carpin Manufacturing, Inc., Waterbury, CT (US)

( * ) Notice: Subject to any disclaimer, the term of this patent is extended or adjusted under 35 U.S.C. 154(b) by 254 days.

(21) Appl. No.: 12/707,042

(22) Filed: Feb. 17, 2010

(65) Prior Publication Data

US 2011/0197390 A1 Aug. 18, 2011

(51) Int. Cl.
*A47B 91/06* (2006.01)

(52) U.S. Cl. ..... 16/42 R

(58) Field of Classification Search ..... 248/188, 248/188.9, 188.5, 188.6, 346.11, 188.4; 16/42 R, 16/42 T, 43, 2.1, 428
See application file for complete search history.

(56) References Cited

U.S. PATENT DOCUMENTS

| | | | | | |
|---|---|---|---|---|---|
| 2,885,719 | A | | 5/1959 | Nordmark et al. | 16/42 |
| 3,389,421 | A | * | 6/1968 | Wheeler | 16/42 R |
| 5,042,764 | A | * | 8/1991 | Carpinella et al. | 248/188.2 |
| 5,191,676 | A | * | 3/1993 | Gerner | 16/42 T |
| 5,873,144 | A | | 2/1999 | Tupper et al. | 16/18 CG |
| 6,219,882 | B1 | * | 4/2001 | Olson | 16/42 R |
| 6,405,409 | B1 | * | 6/2002 | Zirella | 16/421 |
| 7,610,655 | B2 | | 11/2009 | Thaw et al. | 16/42 R |
| 2005/0183234 | A1 | * | 8/2005 | Bushey et al. | 16/42 R |
| 2007/0186374 | A1 | * | 8/2007 | Thaw et al. | 16/42 R |
| 2008/0191106 | A1 | | 8/2008 | Shiffler et al. | 248/188.9 |
| 2008/0209685 | A1 | * | 9/2008 | Dombroski et al. | 16/42 R |
| 2008/0244870 | A1 | * | 10/2008 | Chase | 16/42 R |
| 2008/0245944 | A1 | | 10/2008 | Chase | 248/346.11 |

OTHER PUBLICATIONS

Patents Act 1977: Search Report under Section 17, dated May 26, 2011 for Appl. No. GB1101596.3, www.ipo.gov.uk.

* cited by examiner

*Primary Examiner* — Chuck Y. Mah
(74) *Attorney, Agent, or Firm* — Alix, Yale & Ristas, LLP

(57) ABSTRACT

A replacement furniture glide includes a shell assembly and a foot assembly. The shell assembly includes an upper portion forming a chamber adapted to receive a conventional furniture glide affixed to a furniture leg. A lower portion extends downward from the upper portion. The shell assembly is divided vertically into multiple sections. The foot assembly includes an upper mounting member and a lower floor engagement member that is connected to the mounting member. The shell assembly lower portion is received within an upwardly extending cavity in the foot assembly mounting member to releaseably lock the shell assembly sections together. The shell assembly sections are separated by withdrawing the shell assembly lower portion from the foot assembly mounting member cavity to unlock the shell assembly sections.

19 Claims, 6 Drawing Sheets

REPLACEMENT FURNITURE GLIDE

BACKGROUND

The present invention relates to furniture glides, and more particularly to furniture glides that attach to an existing furniture glide.

Furniture glides are available in a variety of styles and constructions, but an essential purpose is to provide an upper portion for receiving a furniture leg and a lower portion defining a sliding surface. U.S. Pat. Nos. 5,991,974, "Swivelling Furniture Glide", and 6,154,923, "High Hold Furniture Glide", and U.S. Publication US2002/0088082A1 describe glides of the type having a three main components: (1) a ferrule including a bottom wall, an upstanding cylindrical side wall extending from the bottom wall and defining a socket for receiving a furniture leg, and clip means within the socket, for engaging a received furniture leg, (2) a swivelable glide support shell affixed to the bottom wall of the ferrule, and (3) a glide base affixed to the support shell and defining a substantially flat sliding surface for contacting the floor.

U.S. Pat. No. 6,405,982, "Self-Attaching Sliding Support for Articles of Furniture", describes another type of glide that does not have a ferrule or swivel capability, but rather consists of a generally cup-shaped, unitary body of a resilient element for gripping the legs and an integrated slidable base element for contact with the floor.

In these and other known furniture glides, the sliding surface for contacting the floor is of a material specifically chosen for surface on which the furniture glide will rest. Typical base element materials include steel (usually selected for carpeted floors), hard plastics such as nylon or polyethylene (typically selected for tile floors and older vinyl flooring products containing asbestos), or soft plastics (typically selected for vinyl flooring products that do not contain asbestos and wood floors). The sliding surfaces composed of soft plastics are subject to wear.

Traditionally, the furniture glide must be replaced if the furniture is moved to a different location and the base element material is not appropriate for use with the floor at that location. Similarly, furniture glides having a sliding surface composed of soft plastics or felt have been replaced when the sliding surface experienced excessive wear.

SUMMARY

There is provided a replacement furniture glide comprising a shell assembly and a foot assembly. The shell assembly includes an upper portion forming a chamber adapted to receive a conventional furniture glide affixed to a furniture leg. A lower portion extends downward from the upper portion. The shell assembly is divided vertically into multiple sections. The foot assembly includes an upper mounting member and a lower floor engagement member that is connected to the mounting member. The shell assembly lower portion is received within an upwardly extending cavity in the foot assembly mounting member to releaseably lock the shell assembly sections together. The shell assembly sections are separated by withdrawing the shell assembly lower portion from the foot assembly mounting member cavity to unlock the shell assembly sections.

The shell assembly upper portion includes an opening adapted to receive the furniture leg or a portion of the conventional furniture glide.

The foot assembly mounting member may include an outer ring and an axial sleeve extending upward from an intermediate floor, with an inner wall of the outer ring and an outer wall of the axial sleeve forming the cavity for receiving the shell assembly lower portion. The shell assembly lower portion may have a substantially cylindrical shape and the foot assembly mounting member outer ring and an axial sleeve may form an annular cavity.

The shell assembly lower portion projects downwardly from a proximal end to a distal end and may have a projection disposed intermediate the proximal end and the distal end that extends laterally outward from an outer surface of the shell assembly lower portion. In this variation, the inner wall of the foot assembly mounting member outer ring include a circumferential slot that receives the projection of the shell assembly lower portion to releaseably lock the shell assembly sections together.

The lower surface of the shell assembly upper portion or the upper surface of the foot assembly mounting member may include a slot adapted to receive a tool for separating the foot assembly from the shell assembly.

The foot assembly mounting member sleeve may include an axial opening extending from an upper surface of the sleeve. A bumper member composed of a compressible material positioned in the opening has a head projecting upwardly beyond the sleeve upper surface.

The foot assembly floor engagement member is fixedly connected to the foot assembly mounting member by an adhesive or a weld. The foot assembly floor engagement member may also be connected to the foot assembly mounting member by a protrusion that extends radially outward from an outer sidewall of the mounting member that is received in a circumferential slot in an inner sidewall of the floor engagement member.

BRIEF DESCRIPTION OF THE DRAWINGS

The present invention may be better understood and its numerous objects and advantages will become apparent to those skilled in the art by reference to the accompanying drawings in which.

DETAILED DESCRIPTION

Figure 1:
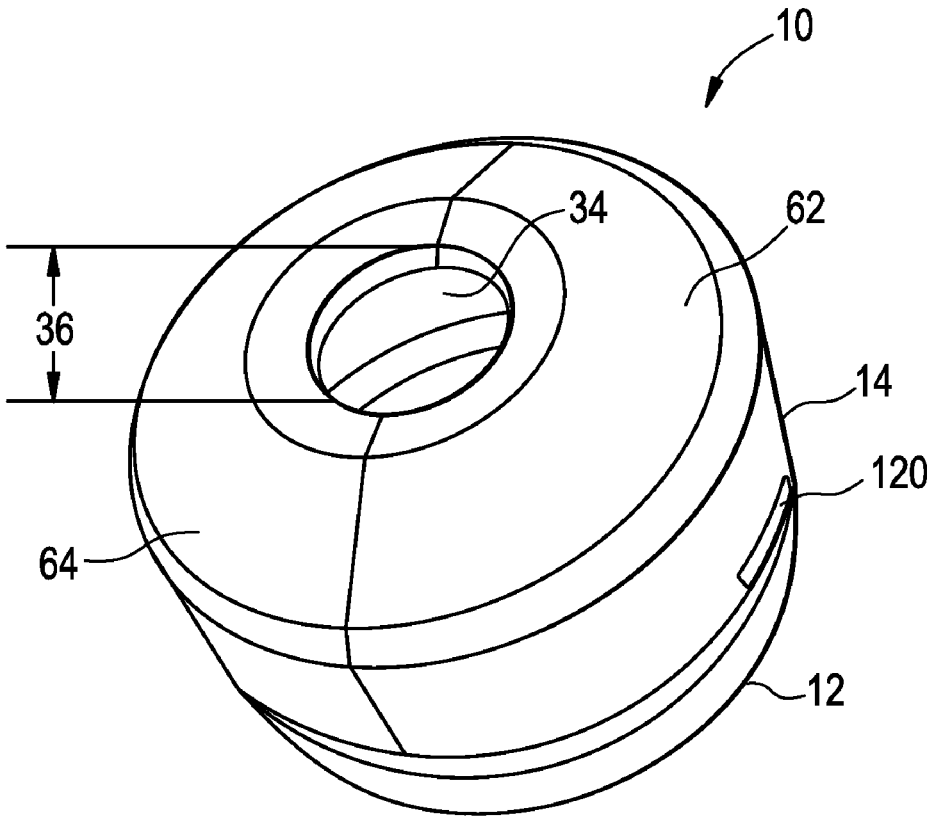
FIG. 1 is a perspective view of a furniture glide in accordance with the disclosure.
Figure 2:
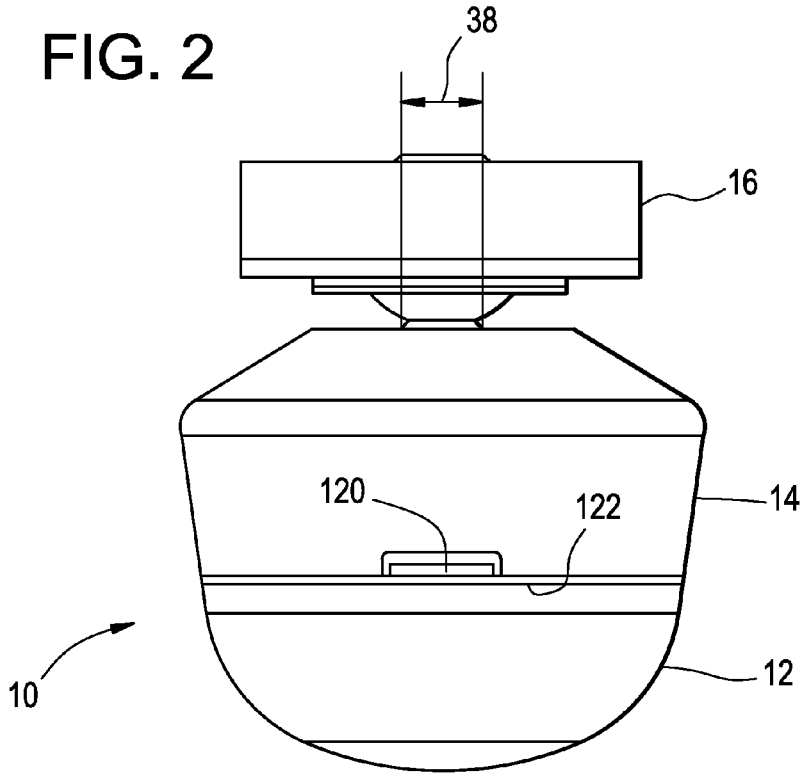
FIG. 2 is a side view of the furniture glide of FIG. 1, showing the furniture glide mounted to a conventional furniture glide.
Figure 3:
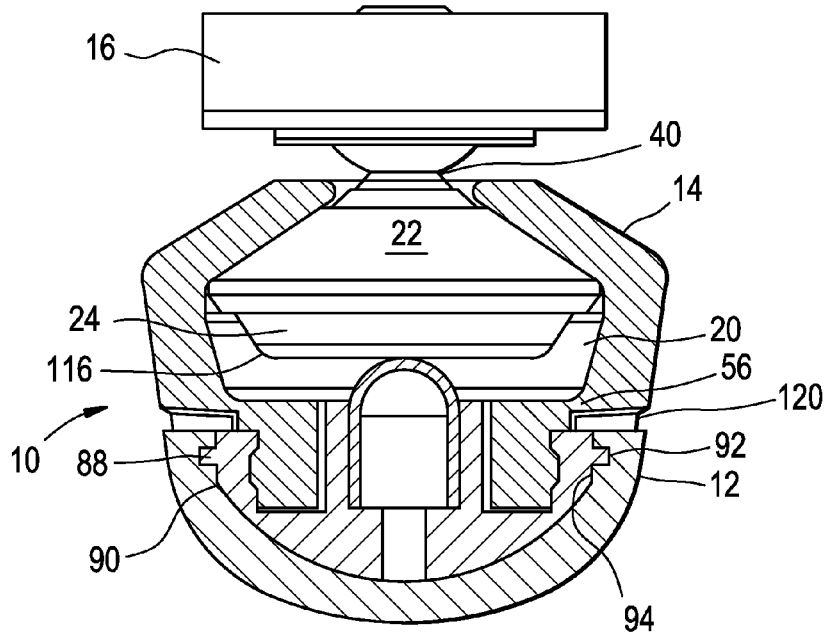
FIG. 3 is a cross-sectional view taken along line 3-3 of FIG. 2.

With reference to FIGS. 1-3, a replacement furniture glide 10 in accordance with the disclosure includes a foot assembly 12 and a shell assembly 14 that mounts the foot assembly 12 to a conventional furniture glide 16 affixed to a furniture leg.

Figure 4:
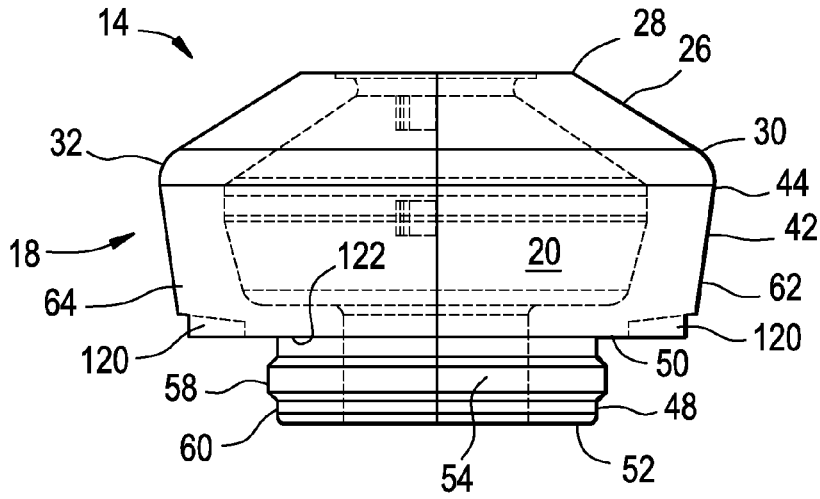
FIG. 4 is a side view, partly in phantom, of the shell assembly of FIG. 1.

With additional reference to FIGS. 3 and 4, the shell assembly 14 has an upper portion 18 defining a chamber 20 adapted to receive a conventional furniture glide 16. In the example shown in FIG. 3, the conventional furniture glide 16 includes an upper segment 22 having a generally frustoconical shape and a lower segment 24 for engaging a floor surface. The shell assembly upper portion chamber 20 has a shape that is complementary to the shape of the conventional furniture glide 16 to ensure that the shell assembly 14 may be installed on the conventional furniture glide 16 and to limit relative motion between the shell assembly 14 and the conventional furniture glide 16. Accordingly, the shell assembly upper portion 18 may include an upper segment 26 having a generally frustoconical shape forming an upper reduced portion 28 and a lower expanded portion 30 defining an outer edge 32. The upper segment 26 defines a substantially circular opening 34 at the reduced portion 28 having a diameter 36 substantially equal to, or slightly greater than, the outer diameter 38 of the upper end 40 of the conventional furniture glide 16 whereby the upper end 40 of the conventional furniture glide 16 extends through opening 34. The lower segment 42 may have an inverted generally frustoconical shape, forming an upper expanded portion 44 and a lower reduced portion 46 or a cylindrical shape.

A cylindrical lower portion 48 projects longitudinally from a proximal end 50 to a distal end 52 and defines a passage 54 extending from the proximal end 50 to the distal end 52. A laterally extending shelf 56 connects the lower portion proximal end 50 to the upper portion 18. A projection 58 disposed intermediate the proximal end 50 and the distal end 52 extends laterally outward from the outer surface 60 of the lower portion 48.

With additional reference to FIGS. 6-9, the shell assembly 14 comprises first and second shell halves 62, 64. The first shell half 62 includes a number (np) of pins 66 that extend from the shell half face. The second shell half 64 includes a number (no) of openings 70 extending from the shell half face 72 into the shell half body 74, where no is greater to or equal than np. The diameters of the pins 66 and openings 70 are selected such that the surface 76 of the pins 66 frictionally engage the surface 78 of the openings 70 when the shell halves 62, 64 are mounted together while allowing the shell halves 62, 64 to be separated without the use of tools. The pins 66 may be integrally formed with the first half shell body 80.

Figure 5:
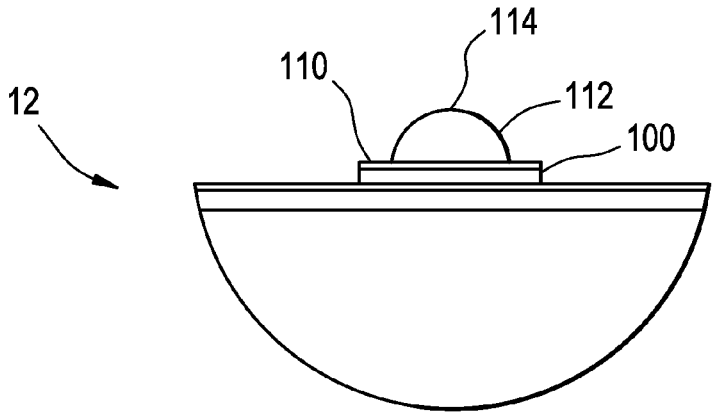
FIG. 5 is a side view of the foot assembly of FIG. 1.
Figure 6:
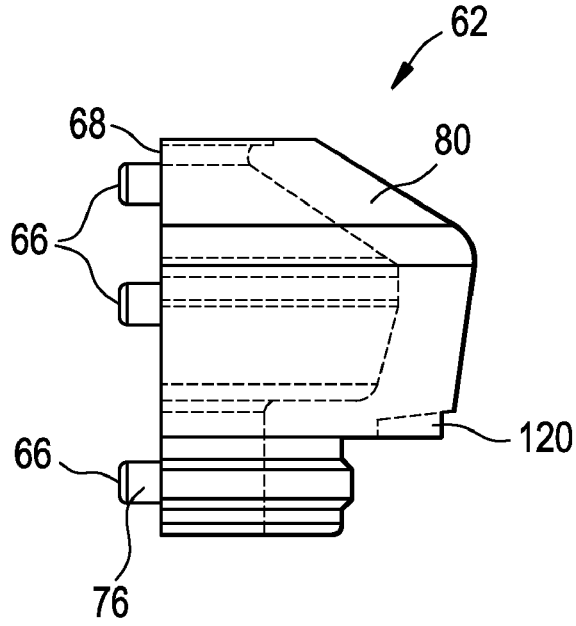
FIG. 6 is a side view, partly in phantom, of the first shell half of FIG. 4.
Figure 7:
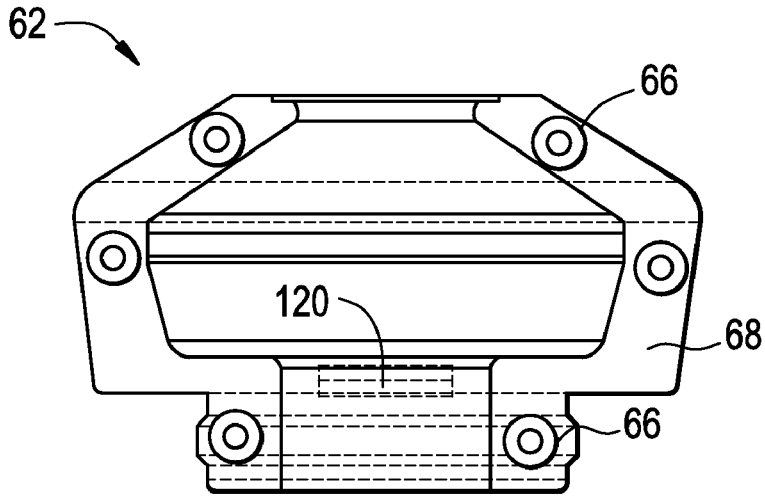
FIG. 7 is a front view of the first shell half of FIG. 6.
Figure 8:
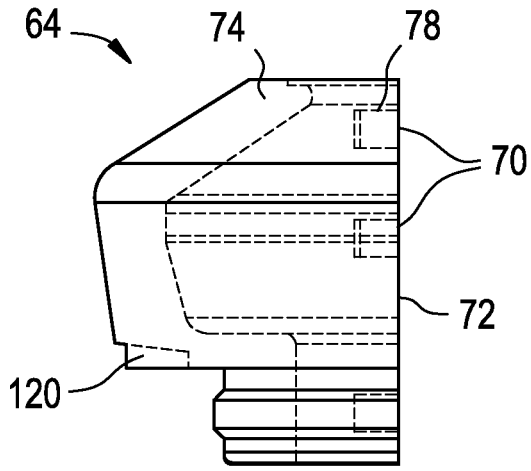
FIG. 8 is a side view, partly in phantom, of the second shell half of FIG. 4.
Figure 9:
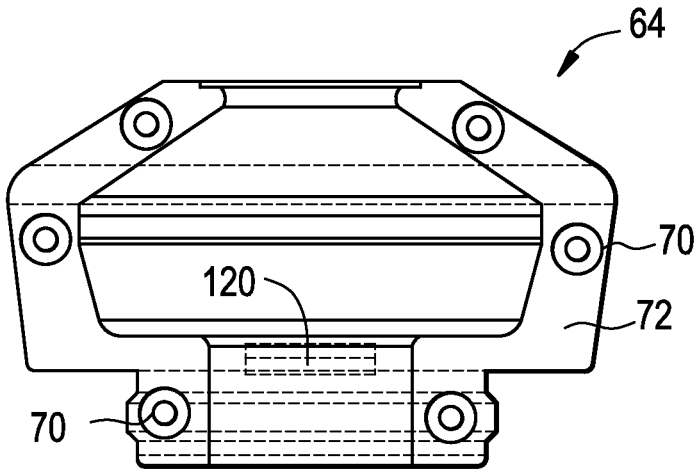
FIG. 9 is a front view of the second shell half of FIG. 8.
Figure 10:
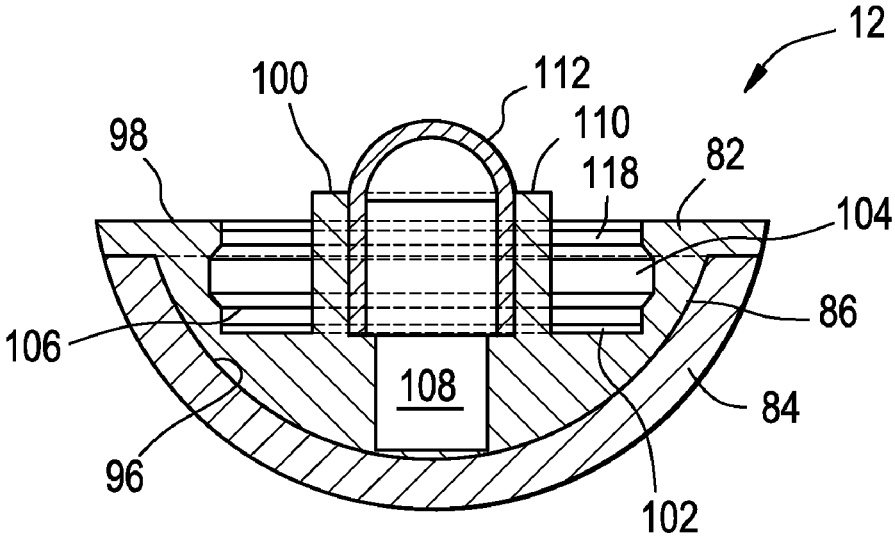
FIG. 10 is a cross-sectional view taken along line 10-10 of FIG. 5.

With additional reference to FIGS. 5 and 10, the foot assembly 12 includes a mounting member 82 and a floor engagement member 84 that is fixedly connected to the mounting member 83. The floor engagement member 84 is composed of a material chosen for surface on which the furniture glide 10 will rest. For example, the floor engagement member 84 may be composed of steel if the floor is carpeted. Alternatively, the floor engagement member 84 may be composed of a relatively soft and/or resilient material such as a soft plastic if the floor is wood or a vinyl flooring product that does not contain asbestos. In the example where the floor engagement member 84 is composed of a relatively soft and/or resilient material, the mounting member 82 provides mechanical support to the floor engagement member 84. The floor engagement member 84 may be connected to the mounting member 83 by an adhesive layer 86 disposed between the floor engagement member inner surface and the mounting member outer surface, a weld or by other means. The floor engagement member 84 may further be connected to the mounting member 82 by a protrusion 88 that extends radially outward from the outer sidewall 90 of the mounting member 82 and is received in an associated circumferential slot 92 in the inner sidewall 94 of the floor engagement member 84.

In the example shown in the Figures, the mounting member 82 has a substantially circular shape and has a rounded outer surface 96. Similarly, in the example the floor engagement member 84 has a shape that substantially conforms to the shape of the mounting member outer surface 96. An outer ring 98 and an axial sleeve 100 extend upward from an intermediate floor 102 of the mounting member 82. A circumferential slot 104 in the outer ring inner sidewall 106 receives the lower portion projection 58 to lock the first and second shell halves 62, 64 together as described in greater detail below. An axial opening 108 originating at the upper surface 110 of the sleeve 100 may extend to the mounting member outer surface 96, as shown in FIG. 3, or may terminate at a point intermediate the sleeve upper surface 110 and the mounting member outer surface 96. A bumper member 112 composed of a compressible material may be positioned in the opening 108 with the domed head 114 of the bumper member 112 projecting upwardly beyond the sleeve upper surface 110. The bumper member head 114 engages the bottom surface 116 of the installed conventional furniture glide 16 when the replacement furniture glide 10 is installed to dampen any movement between the conventional furniture glide 16 and the replacement furniture glide 10.

The replacement furniture glide 10 is installed by inserting the installed conventional furniture glide 16 into one of the first and second shell halves 62, 64 and then the other of the first and second shell halves 62, 64, with the first shell half pins 66 being inserted into the second shell half openings 70. Frictional engagement between the surfaces 76, 78 of the pins 66 and the openings 70 will retain the shell assembly 14 in place while the shell assembly lower portion 48 is inserted into the cavity 118 between the outer ring 98 and the inner sleeve 100 of the foot assembly mounting member 82. The replacement furniture glide 10 may be removed by inserting the blade tip of a screwdriver or similar tool into slots 120 provided in the bottom surface 122 of the lower segment 42 of the shell assembly upper portion 18 (FIGS. 1, 2, 3 and 4) and applying an upward or downward force to the screwdriver handle whereby the blade forces the shell assembly lower portion 48 out of cavity 118. After the foot assembly 12 is removed from the shell assembly 14, pulling the two shell halves 62, 64 away from each other provides sufficient force to overcome the frictional engagement between the surfaces 76, 78 of the pins 66 and the openings 70 to allow the shell halves 62, 64 to be separated.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A replacement furniture glide comprising:

a shell assembly including an upper portion defining a chamber adapted to receive a conventional furniture glide affixed to a furniture leg and a lower portion extending downward from the upper portion, the shell assembly being divided vertically into a plurality of sections; and a foot assembly including an upper mounting member and a lower floor engagement member that is connected to the mounting member, the mounting member including an outer ring and an axial sleeve extending upward from an intermediate floor, an inner wall of the outer ring and an outer wall of the axial sleeve defining a cavity for receiving the shell assembly lower portion to releaseably lock the shell assembly sections together wherein the shell assembly sections are separated by withdrawing the shell assembly lower portion from the foot assembly mounting member cavity to unlock the shell assembly sections.

2. The replacement furniture glide of claim 1 wherein the shell assembly upper portion defines an opening adapted to receive the furniture leg or a portion of the conventional furniture glide.

3. The replacement furniture glide of claim 1 wherein the shell assembly lower portion has a substantially cylindrical shape and the foot assembly mounting member outer ring and an axial sleeve defining an annular cavity.

4. The replacement furniture glide of claim 1 wherein the shell assembly lower portion projects downwardly from a proximal end to a distal end and a projection disposed intermediate the proximal end and the distal end extends laterally outward from an outer surface of the shell assembly lower portion.

5. The replacement furniture glide of claim 4 wherein the shell assembly lower portion defines a passage extending from the proximal end to the distal end.

6. The replacement furniture glide of claim 4 wherein a laterally extending shelf connects the proximal end of the shell assembly lower portion to the shell assembly upper portion.

7. The replacement furniture glide of claim 4 wherein the inner wall of the foot assembly mounting member outer ring defines a circumferential slot, the projection of the shell assembly lower portion being received within the foot assembly mounting member slot to releaseably lock the shell assembly sections together.

8. The replacement furniture glide of claim 7 wherein a lower segment of the shell assembly upper portion has a lower surface and the foot assembly mounting member has an upper surface, the lower surface of the shell assembly upper portion lower segment or the upper surface of the foot assembly mounting member defining a slot adapted to receive a tool for separating the foot assembly from the shell assembly.

9. The replacement furniture glide of claim 1 wherein the foot assembly mounting member sleeve defines an axial opening extending from an upper surface of the sleeve, the furniture glide further comprising a bumper member composed of a compressible material positioned in the opening.

10. The replacement furniture glide of claim 9 wherein the bumper member has a head projecting upwardly beyond the sleeve upper surface.

11. The replacement furniture glide of claim 1 wherein the shell assembly sections comprise first and second shell halves, the first shell half including at least one pin that extends from a face of the first shell half, the second shell half including at least one opening extending from a face of the second shell half face, the first shell half pins being received in the second shell half openings.

12. The replacement furniture glide of claim 11 wherein each first shell half pin has an outside diameter and outer surface and each second shell half opening has an inside diameter and an inner surface, the pin outside diameter and the opening inside diameter being selected such that the outer surface of the pin frictionally engages the inside surface of the opening.

13. The replacement furniture glide of claim 1 wherein the foot assembly floor engagement member is fixedly connected to the foot assembly mounting member by an adhesive or a weld.

14. A replacement furniture glide comprising:

a shell assembly including an upper portion defining a chamber adapted to receive a conventional furniture glide affixed to a furniture leg and a lower portion extending downward from the upper portion, the shell assembly being divided vertically into a plurality of sections; and a foot assembly including an upper mounting member and a lower floor engagement member that is connected to the foot assembly mounting member by a protrusion that extends radially outward from an outer sidewall of the mounting member that is received in a circumferential slot in an inner sidewall of the floor engagement member, the mounting member defining an upwardly extending cavity, the shell assembly lower portion being received within the foot assembly mounting member cavity to releaseably lock the shell assembly sections together wherein the shell assembly sections are separated by withdrawing the shell assembly lower portion from the foot assembly mounting member cavity to unlock the shell assembly sections.

15. A replacement furniture glide comprising:

a shell assembly including an upper portion defining a chamber adapted to receive a conventional furniture glide affixed to a furniture leg and a lower portion extending downward from the upper portion, the shell assembly lower portion having a substantially cylindrical shape, the shell assembly upper portion defining an opening adapted to receive the furniture leg or a portion of the conventional furniture glide, the shell assembly being divided vertically into a plurality of sections; and a foot assembly including an upper mounting member and a lower floor engagement member that is connected to the mounting member, the foot assembly mounting member including an outer ring and an axial sleeve extending upward from an intermediate floor, an inner wall of the outer ring and an outer wall of the axial sleeve defining an annular cavity, the shell assembly lower portion being received within the foot assembly mounting member cavity to releaseably lock the shell assembly sections together;

wherein the shell assembly sections are separated by withdrawing the shell assembly lower portion from the foot assembly mounting member cavity to unlock the shell assembly sections.

16. The replacement furniture glide of claim 15 wherein the inner wall of the foot assembly mounting member outer ring defines a circumferential slot, the shell assembly lower portion projects downwardly from a proximal end to a distal end, and a projection disposed intermediate the proximal end and the distal end is received within the foot assembly mounting member slot to releaseably lock the shell assembly sections together.

17. The replacement furniture glide of claim 16 wherein a lower segment of the shell assembly upper portion has a lower surface and the foot assembly mounting member has an upper surface, the lower surface of the shell assembly upper portion lower segment or the upper surface of the foot assembly mounting member defining a slot adapted to receive a tool for separating the foot assembly from the shell assembly.

18. The replacement furniture glide of claim 15 wherein the foot assembly mounting member sleeve defines an axial opening extending from an upper surface of the sleeve, the furniture glide further comprising a bumper member composed of a compressible material positioned in the opening, the bumper member having a head projecting upwardly beyond the sleeve upper surface.

19. A replacement furniture glide comprising:

a shell assembly including an upper portion defining a chamber adapted to receive a conventional furniture glide affixed to a furniture leg and a lower portion extending downward from the upper portion, the shell assembly lower portion having a substantially cylindrical shape, the shell assembly being divided vertically into first and second halves; and a foot assembly including an upper mounting member and a lower floor engagement member that is connected to the mounting member, the mounting member including an outer ring and an axial sleeve extending upward from an intermediate floor, an inner wall of the outer ring and an outer wall of the axial sleeve defining an annular cavity for receiving the shell assembly lower portion, whereby the shell assembly first and second halves are releaseably locked together;

wherein the shell assembly first and second halves are separated by withdrawing the shell assembly lower portion from the foot assembly mounting member cavity to unlock the shell assembly first and second halves.

* * * * *